US012796877B2

(12) United States Patent
Bach et al.

(10) Patent No.: US 12,796,877 B2
(45) Date of Patent: Nov. 17, 2026

(54) METHOD FOR IDENTIFYING AN ERROR STATE IN A CLEANING ROBOT

(71) Applicant: BSH Hausgeräte GmbH, Munich (DE)

(72) Inventors: Benedikt Bach, Niederlauer (DE); Markus Moelter, Hollstadt (DE); Frank Schnitzer, Bad Neustadt (DE)

(73) Assignee: BSH Hausgeräte GmbH, Munich (DE)

( * ) Notice: Subject to any disclaimer, the term of this patent is extended or adjusted under 35 U.S.C. 154(b) by 718 days.

(21) Appl. No.: 18/011,870

(22) PCT Filed: Jun. 8, 2021

(86) PCT No.: PCT/EP2021/065286
§ 371 (c)(1),
(2) Date: Dec. 21, 2022

(87) PCT Pub. No.: WO2021/259629
PCT Pub. Date: Dec. 30, 2021

(65) Prior Publication Data

US 2023/0240496 A1 Aug. 3, 2023

(30) Foreign Application Priority Data

Jun. 22, 2020 (DE) ..... 10 2020 207 694.4

(51) Int. Cl.
*A47L 9/19* (2006.01)
*A47L 9/14* (2006.01)
*A47L 9/28* (2006.01)

(52) U.S. Cl.
CPC ..... *A47L 9/19* (2013.01); *A47L 9/1409* (2013.01); *A47L 9/281* (2013.01); *A47L 9/2889* (2013.01); *A47L 2201/06* (2013.01)

(58) Field of Classification Search
CPC ..... A47L 9/281; A47L 9/19; A47L 9/1409; A47L 9/2889; A47L 2201/06
See application file for complete search history.

(56) References Cited

U.S. PATENT DOCUMENTS 10,806,318 B2 10/2020 Erkek et al.
2005/0183229 A1* 8/2005 Uehigashi ..... A47L 9/2805 15/340.1

FOREIGN PATENT DOCUMENTS

| | | | | |
|---|---|---|---|---|
| CN | 101926625 A | * | 12/2010 | |
| CN | 105796010 A | * | 7/2016 | ..... A47L 9/281 |
| CN | 109316132 A | * | 2/2019 | ..... A47L 11/40 |
| DE | 4323222 A1 | * | 4/1995 | ..... G01F 23/14 |
| DE | 102007036157 A1 | * | 2/2009 | ..... A47L 9/2857 |
| DE | 102009035717 A1 | * | 2/2011 | ..... A47L 9/19 |
| DE | 102011006539 A1 | * | 10/2012 | ..... A47L 9/19 |
| EP | 2494900 A1 | * | 9/2012 | ..... A47L 11/4013 |
| EP | 3415065 A1 | * | 12/2018 | ..... A47L 9/2852 |
| EP | 3659485 A1 | * | 6/2020 | ..... A47L 11/4011 |

* cited by examiner

*Primary Examiner* — Marc Carlson
(74) *Attorney, Agent, or Firm* — Laurence A. Greenberg; Werner H. Stemer; Ralph E. Locher

(57) ABSTRACT

A method for identifying an error state in a cleaning robot which has a collection container for collecting dirt. According to the method an average duration for filling the collection container with dirt during the operation of the cleaning robot is determined. The existence of an error state is identified as soon as a single duration for filling deviates from the determined average duration for filling by more than a predefined difference value.

13 Claims, 1 Drawing Sheet

METHOD FOR IDENTIFYING AN ERROR STATE IN A CLEANING ROBOT

FIELD AND BACKGROUND OF THE INVENTION

Figure 1:
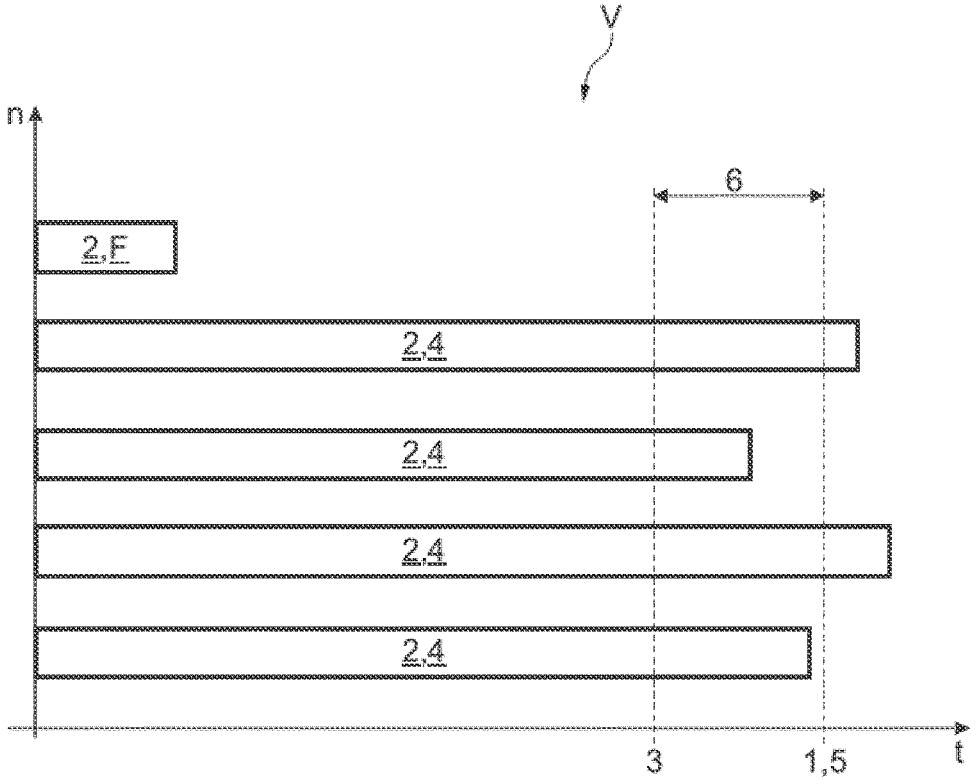

The invention relates to a method for identifying an error state in a cleaning robot and to a cleaning robot with an open-loop/closed-loop control facility that is configured/programmed to carry out this method.

Typical cleaning robots comprise an intake duct through which dirty air sucked in by means of the cleaning robot can flow. Such cleaning robots moreover typically comprise a separator, often realized as a filter, for separating dirt from the dirty air sucked in through the intake duct. In addition, conventional cleaning robots have an exhaust duct for outputting air cleaned by means of the separator. Furthermore, cleaning robots typically comprise a collection container for collecting the separated dirt. A dirt fill level of the collection container is then usually determined by an air pressure difference between the intake duct and exhaust duct of the cleaning robot being monitored. If this air pressure difference rises sharply, the attainment of a maximum fill level of the collection container is identified. In the event that the existence of a maximum fill level has been identified, an error message is then typically displayed to a user of the cleaning robot, wherein the cleaning robot continues cleaning without interruption, however.

In this context, it has often proved disadvantageous that, despite the event message being displayed, an error state of the type that may exist due to a blockage of the intake duct is in practice only noticed by the user—on account of the interruption-free continuation of the cleaning process—when the user inspects the cleaning robot. This can result in the cleaning robot having no longer picked up dirt while the cleaning process continued, and having instead "spread" it over the surface still to be cleaned.

SUMMARY OF THE INVENTION

It is therefore an object of the present invention—in particular in order to eliminate the disadvantage described above—to specify an improved method for identifying an error state in a cleaning robot. Moreover a cleaning robot is to be created that is configured/programmed to carry out such a method.

These objects are achieved by the method as claimed and/or by a cleaning robot as claimed. Preferred embodiments are the subject matter of the dependent claims.

The basic idea of the invention is accordingly to compare an average duration for filling the collection container of the cleaning robot with dirt during operation of the cleaning robot with a single duration for filling the collection container, in order to identify in this way the existence of an error state of the cleaning robot in the event that the single duration for filling deviates too sharply from the average duration for filling. If the error state is identified, the cleaning process can be interrupted.

It is thus advantageously possible—in particular in the event that the error state is caused by a blockage of the intake duct—to avoid the cleaning robot continuing to pass over the surface to be cleaned and thereby spreading dirt, in particular wet dirt, over the remaining surface still to be cleaned, instead of removing dirt from it and in this way cleaning it. In addition, a cleaning robot defect that may occur due to the error state can be prevented. Moreover, the average duration for filling depends on an average dirt level of the surface to be cleaned, so that the cleaning robot learns how long it takes on average in its usual environment until its collection container is full. The error state can therefore also be reliably identified when the cleaning robot is operated in an environment that differs from a normal environment.

A method in accordance with the invention for identifying an error state in a cleaning robot having a collection container for collecting dirt provides for an average duration for filling the collection container with dirt to be determined during operation of the cleaning robot. Moreover, in accordance with the method, the existence of an error state is identified as soon as a single duration for filling deviates from the determined average duration for filling by more than a predefined difference value that specifies a threshold value. As already indicated above, this offers the advantage that a failure of or damage to the cleaning robot can be avoided in the event of the error state. Moreover, the value of the average duration for filling depends on a (surface-specific) average dirt level of the surface to be cleaned by the cleaning robot so that, by means of the method, it is also possible reliably to identify the existence of the error state in the event that the surface to be cleaned has an above-average level of dirt based on the mean, such as may be the case in a workshop, for example.

In accordance with a preferred development of the method, what is used as the single duration for filling is the operating time of the cleaning robot during which it is cleaning, this being the operating time that has elapsed between one emptying of the collection container and the subsequent identification that a predefined maximum fill level of the collection container has been attained. Therefore only the operating time of the cleaning robot during which it is actually cleaning is considered. In this way, advantageously the duration for filling or the average duration for filling can be determined particularly precisely.

In accordance with a further preferred development of the method, the error state is classified as having occurred as soon as a single duration for filling is shorter, by more than the predefined difference value, than the determined average duration for filling, so that the threshold value is fallen below. In the event that the threshold value is fallen below in this way, the existence of the error state is particularly likely and so it is advantageously possible to avoid the error state being identified without it actually being present.

In a further preferred development of the method, the average duration for filling is calculated by forming the arithmetic mean from single durations for filling. This permits a particularly simple determination of the duration for filling from previous single durations for filling.

A further advantageous development of the method provides that the difference value is specified as an absolute deviation from the average duration for filling. Here, this absolute deviation is a defined time value, expediently dependent on the cleaning performance of the cleaning robot. The absolute deviation is particularly preferably a value of 1 to 3 hours, most preferably 2 hours. Performing the method developed in this way pays off in the form of a particularly low computing effort.

A further advantageous development of the method provides that the difference value is specified as a relative deviation from the average duration for filling. Here, this relative deviation preferably corresponds to a multiple standard deviation, most preferably the triple standard deviation, of the single durations for filling considered for the average duration for filling, from the average duration for filling. This permits a particularly reliable identification of the existence of the error state.

In accordance with a further advantageous development of the method, the cleaning robot can be operated in at least two different operating modes, which can be cleaning modes. Here, the determination of the average duration for filling and the associated identification of the error state are performed individually for each operating mode. The operating modes preferably differ in respect of a suction power of the cleaning robot. Consequently the method advantageously allows the existence of an error state to be identified reliably also in different operating modes adjusted to different requirements imposed on the cleaning robot.

In accordance with a further advantageous development, the cleaning robot can also determine the average duration for filling for operation in mixed operating modes. For this purpose, the respective average durations for filling are calculated from cleaning cycles, which, from emptying the collection container until identifying that a predefined maximum fill level of the collection container has been attained, were each performed completely in just one of the operating modes. As soon as these average durations for filling exist, the current equivalent single duration for filling and the equivalent average duration for filling in the cleaning cycle currently being performed can be formed with the (e.g. time-based, distance-based or surface-based) weighted share of the respective operating modes. Advantageously, the behavior of the robot as configured by the user is thus considered.

In a further preferred development of the method, the cleaning robot generates a digital map of a surface to be cleaned, wherein this digital map is stored in a digital map store of the cleaning robot. Such a map can comprise the surface to be cleaned in one or more spaces. Here, it is identified if the cleaning robot is cleaning a surface that has already been mapped. The determination of the average duration for filling and the associated identification of an error state are performed individually for each digital map or each space. This has the advantageous consequence that, depending on which digital map or which space the cleaning robot has identified, a different average duration for filling is determined, or is used for the identification of the error state.

In accordance with a further preferred development of the method, an air pressure difference between an intake duct and an exhaust duct of the cleaning robot is monitored in order to determine single durations for filling during operation of the cleaning robot. This offers a way of determining such a single duration for filling that is particularly simple to implement.

In a further preferred development of the method, in the event that the error state is identified, a fault message is generated, which is displayed to or otherwise brought to the attention of a user of the cleaning robot by means of an information facility of the cleaning robot configured for that purpose and—alternatively or in addition—by means of a mobile device connected for data-transmission purposes to the cleaning robot. This permits a particularly intuitive reaction by the user of the cleaning robot to the identified error state.

The invention further relates to a cleaning robot having a collection container for collecting dirt and having an open-loop/closed-loop control facility that is configured/programmed to carry out the method in accordance with the invention presented above.

Further key features and advantages of the invention will become apparent from the dependent claims, the drawing, and the associated description of the FIGURE with reference to the drawing.

It is understood that the features mentioned above and yet to be explained below are usable not only in the combination specified in each case but also in other combinations or alone without departing from the scope of the present invention.

Preferred exemplary embodiments of the invention are shown in the drawing and are explained in more detail in the description below.

DETAILED DESCRIPTION OF THE INVENTION

The single FIG. 1 illustrates an example of a method V in accordance with the invention for identifying an error state F in a cleaning robot in accordance with the invention, which cleaning robot comprises a collection container for collecting dirt and an open-loop/closed-loop control facility that is configured/programmed to carry out the method V. In accordance with the method V, an average duration 1 for filling the collection container with dirt is determined during operation of the cleaning robot. In accordance with the method V, the existence of an error state F is furthermore identified as soon as a single duration 2 for filling deviates from the determined average duration 1 for filling by more than a predefined difference value 6, i.e. when a single duration 2 for filling falls below a predefined threshold value 3 predefined by means of the difference value 6. What is used in this context as the single duration 2 for filling is the operating time 4 of the cleaning robot during which it is cleaning, this being the operating time that has elapsed between one emptying of the collection container and the subsequent identification that a predefined maximum fill level of the collection container has been attained. The error state F is classified as having occurred as soon as a single duration 2 for filling is shorter, by more than the predefined difference value 6, than the determined average duration 1 for filling. The average duration 1 for filling is calculated by forming the arithmetic mean 5 from single durations 2 for filling. The average duration for filling is calculated for example by forming the arithmetic mean 5 from n single durations 2 for filling. In the example shown, the average duration 1 for filling is calculated by forming the arithmetic mean 5 from four single durations 2 for filling. Here, the difference value 6 is specified as a deviation from the average duration 1 for filling.

This deviation specifying the difference value 3 can be an absolute deviation from the average duration 1 for filling. The absolute deviation can be a defined time value of 1 to 3 hours, for example 2 hours. Alternatively, the deviation specifying the difference value 6 can be a relative deviation from the average duration 1 for filling. Here, this relative deviation can correspond to a multiple standard deviation, for example the triple standard deviation, of the single durations 2 for filling considered for the average duration 1 for filling, from the average duration 1 for filling. The determination of the average duration 1 for filling or the formation of the arithmetic mean 5 can be reset after the identification of an error state F.

The cleaning robot can be operated in at least two different operating modes. Such operating modes are cleaning modes for example and differ in respect of a suction power of the cleaning robot. The determination of the average duration 1 for filling and the associated identification of an error state F are performed individually for each operating mode. This means that, depending on the operating mode in which the cleaning robot is being operated, a different average duration 1 for filling that is assigned to this operating mode is used as a reference value.

The cleaning robot can also determine the average duration 1 for filling for operation in mixed operating modes. For this purpose, the respective average durations 1 for filling are calculated from cleaning cycles, which, from emptying the collection container until identifying that a predefined maximum fill level of the collection container has been attained, were each performed completely in just one of the operating modes. As soon as these average durations for filling exist, the current equivalent single duration 2 for filling and the equivalent average duration 1 for filling in the cleaning cycle currently being performed can be formed with the (e.g. time-based, distance-based or surface-based) weighted share of the respective operating modes.

Moreover, the cleaning robot can be configured to generate a digital map of a surface to be cleaned and to store this digital map in a digital map store of the cleaning robot. Here, it is identified if the cleaning robot is cleaning a surface that has already been mapped. The determination of the average duration 1 for filling and the associated identification of an error state F are then performed individually for each digital map. This means that, if the cleaning robot has identified a surface that has already been mapped, the average duration 1 for filling assigned to this digital map is used for the method V.

An air pressure difference between an intake duct and an exhaust duct of the cleaning robot is monitored in order to determine the single durations 2 for filling during operation of the cleaning robot. A separation facility for separating dirt from dirty air sucked in through the intake duct, and the collection container, may be arranged between the intake duct and the exhaust duct of the cleaning robot. A fault message is generated in the event that the error state F is identified. The fault message is displayed to a user of the cleaning robot. The fault message can be provided to the user of the cleaning robot by means of an information facility of the cleaning robot configured for that purpose and—alternatively or in addition—by means of a mobile device connected for data-transmission purposes to the cleaning robot.

LIST OF REFERENCE CHARACTERS

1 Average duration for filling
2 Single duration for filling
3 Threshold value
4 Operating time
5 Arithmetic mean
6 Difference value
F Error state
V Method

The invention claimed is:

1. A method for operating a cleaning robot having a collection container for collecting dirt and an open-loop/closed-loop control facility configured and programmed to carry out the following method steps, the method comprising:

operating the cleaning robot in at least an operating mode;

determining a single duration for filling the collection container with dirt during the operation of the cleaning robot by monitoring an air pressure difference between an intake duct and an exhaust duct of the cleaning robot in order to determine single durations for filling during operation of the cleaning robot;

determining an average duration for filling the collection container with dirt during the operation of the cleaning robot calculating the average duration for filling by forming an arithmetic mean from a plurality of single durations for filling;

identifying an existence of an error state when a single duration for filling deviates from the average duration for filling by more than a predefined difference value that specifies a threshold value; and interrupting the operation of the cleaning robot if the error state is identified.

2. The method according to claim 1, which comprises using as the single duration for filling an operating time of the cleaning robot during which the robot is cleaning, the operating time being a time that has elapsed between an emptying of the collection container and a subsequent identification that a predefined maximum fill level of the collection container has been attained.

3. The method according to claim 1, which comprises classifying the error state as having occurred as soon as a single duration for filling is shorter, by more than the predefined difference value, than the determined average duration for filling, so that the threshold value has been undershot.

4. The method according to claim 1, which comprises specifying the difference value as an absolute deviation from the average duration for filling, the absolute deviation having a predefined time value.

5. The method according to claim 4, wherein the absolute deviation has a time value of 1 to 3 hours.

6. The method according to claim 5, wherein the absolute deviation has a time value of approximately 2 hours.

7. The method according to claim 1, which comprises specifying the difference value as a relative deviation from the average duration for filling.

8. The method according to claim 7, wherein the relative deviation corresponds to a multiple standard deviation of the single duration for filling considered for the average duration for filling from the average duration for filling.

9. The method according to claim 8, wherein the relative deviation is a triple standard deviation.

10. The method according to claim 1, which comprises selectively operating the cleaning robot in at least two different operating modes, and determining the average duration for filling and an associated identification of an error state individually for each operating mode, wherein the operating modes differ in respect of a suction power of the cleaning robot.

11. The method according to claim 1, which comprises selectively operating the cleaning robot in at least two different operating modes, and determining an equivalent average duration for filling and of an equivalent single duration for filling and calculating an associated identification of an error state on a basis of the average durations for filling determined for the single operating modes weighted with times spent in the respective operating modes, or distances covered, or surfaces cleaned.

12. The method according to claim 1, which comprises:

generating with the cleaning robot a digital map of a surface to be cleaned and storing the digital map in a digital map memory;

determining whether the cleaning robot is cleaning a surface that has already been mapped; and performing a determination of the average duration for filling and the associated identification of an error state individually for each digital map.

13. The method according to claim 1, which comprises, when an error state is identified, generating a fault message to be conveyed to a user of the cleaning robot by way of an information facility of the cleaning robot and/or by way of a mobile device connected for data communication to the cleaning robot.

* * * * *